US007380677B2

(12) United States Patent
Willim

(10) Patent No.: US 7,380,677 B2
(45) Date of Patent: Jun. 3, 2008

(54) CRANE, AS WELL AS A PROCESS FOR RAISING ITS BOOM

(75) Inventor: Hans-Dieter Willim, Ulm (DE)

(73) Assignee: Liebherr-Werk Ehingen- GmbH, Ehingen/Donau (DE)

( * ) Notice: Subject to any disclaimer, the term of this patent is extended or adjusted under 35 U.S.C. 154(b) by 222 days.

(21) Appl. No.: 10/945,451

(22) Filed: Sep. 20, 2004

(65) Prior Publication Data

US 2005/0061762 A1 Mar. 24, 2005

(30) Foreign Application Priority Data

Sep. 19, 2003 (DE) ..... 203 14 561 U

(51) Int. Cl.
*B66C 23/42* (2006.01)

(52) U.S. Cl. ..... 212/298; 212/239; 212/262; 212/299

(58) Field of Classification Search ..... 212/298–300, 212/231, 239, 262
See application file for complete search history.

(56) References Cited

U.S. PATENT DOCUMENTS 2,443,306 A * 6/1948 De Cuir ..... 212/299
2,774,484 A * 12/1956 White ..... 212/178
3,252,585 A * 5/1966 Wieschel ..... 212/295
4,412,622 A * 11/1983 Gyomrey ..... 212/299
4,446,976 A * 5/1984 Imerman et al. ..... 212/304
4,544,071 A * 10/1985 Poock ..... 212/264
5,586,667 A * 12/1996 Landry ..... 212/196
6,474,487 B1 * 11/2002 Kretschmer ..... 212/298

FOREIGN PATENT DOCUMENTS

DE 1 271 341 6/1968
DE 199 44 927 C2 3/2001

* cited by examiner

*Primary Examiner*—Thomas J. Brahan
(74) *Attorney, Agent, or Firm*—Dilworth & Barrese LLP.

(57) ABSTRACT

The within invention concerns a crane with a rotating platform that can rotate on a vertical axle, a boom that is connected to the rotating platform and which can luff on a luffing axle, guying connected on the one hand with the boom and on the other hand with a guy support, which can slew on an axle parallel to the luffing axle of the boom and is connected with the rotating platform and/or the boom foot, as well as an adjustment mechanism, in particular adjustment cabling, that serves for the luffing of the boom and which is connected with the guy support. According to the invention, the crane is also characterized by the presence of an angle adjustment mechanism by means of which the angle of the guy support can be adjusted relative to the boom when the boom is raised.

11 Claims, 2 Drawing Sheets

CRANE, AS WELL AS A PROCESS FOR RAISING ITS BOOM

BACKGROUND OF THE INVENTION

The within invention concerns a crane with a rotating platform that can rotate on a vertical axle, a boom that is connected to the rotating platform and which can luff on a luffing axle, guying connected on the one hand with the boom and on the other hand with a guy support, which can slew on an axle parallel to the luffing axle of the boom and is connected with the rotating platform and/or the boom foot, as well as an adjustment mechanism, in particular adjustment cabling, that serves for the luffing of the boom and which is connected with the guy support. The invention also concerns a process for raising the boom of such a crane.

The raising of very long booms of cranes, for example crawler cranes, becomes increasingly difficult in proportion to the increase in boom length, since on the one hand the erection moment of the boom lying on the ground becomes very large, and on the other hand the lever arm of the adjustment guying usually connected to the superstructure and the guy support becomes very small in relation to the rotation axle of the guy support or the boom. In order to limit the guying forces or cable forces during erection, theoretically the lever arm of the adjustment guying could be improved by inclining the guy support farther back. However, when the boom was steeply inclined, that is, was rotated at close to 90°, the guy support would then be resting right on the rotating platform.

SUMMARY OF THE INVENTION

It is therefore the task of the within invention to create an improved crane of the type initially described, which avoids the disadvantages of the state of the art and advantageously develops said state of the art. Preferably the raising of the boom should be facilitated, on the one hand, and on the other hand the raising of the boom into very vertical positions should not be impeded.

According to the invention, this task is performed by a crane described herein. In terms of technical process, the task is performed by a process described herein. Preferred embodiments of the invention are also the subject herein.

According to the invention, the crane is thus characterized by the presence of an angle adjustment mechanism by means of which the angle of the guy support can be adjusted in relation to the boom when the boom is raised. For the raising of the boom, the guy support can thereby be first pivoted backward away from the boom into upright position with a relatively large angle between guy support and boom. In this upright position of the guy support, the adjustment mechanism or adjustment guying has an improved lever arm in relation to the pivoting point of the guy support or the boom, whereupon it becomes easier to raise the boom from its reclining position on the ground. As soon as the boom has been luffed somewhat farther, preferably at least 45° or more, the guy support can be pivoted toward the boom into operating position with a comparatively smaller angle between guy support and boom. In this operating position of the guy support, the boom can then be luffed farther into very vertical positions without causing the guy to rise to the top of the rotating platform of the crane.

In a further development of the invention, the angle adjustment mechanism for adjusting the angle of the guy support in relation to the boom consists of a length adjustment mechanism by means of which the length of the guying between guy support and boom can be adjusted. The length adjustment mechanism can in principle be designed in a variety of ways. Conceivably the deflection point of the guying on the boom could be designed to slide, or the guying could be designed as cabling, deflected on the guy support, and attached adjustably to the guy support with a winch or a power hoist and a hook and eye coupling. In a further development of the invention, however, the length adjustment mechanism consists of a traction mechanism installed in the guying and operated by outside energy, by means of which said traction mechanism the actual length of the guying can be changed, that is, the guying can be lengthened or shortened. In particular, an hydraulic power lift and/or a regulating pulley can be installed in the guying.

Preferably, said length adjustment mechanism is installed in the guying between the guy support tip and the boom. The guying can thereby be permanently attached on the one hand to the guy support and on the other hand to the boom.

The adjustment mechanism by means of which the boom can be luffed has preferably an adjustment cable multi-reeved between the superstructure on the one hand and the guy support on the other hand. To luff the boom, the adjustment mechanism is shortened, the boom thereby being pivoted upward, whereupon the guy support is synchronously pivoted backward. If the adjustment cable is released and the adjustment mechanism is thereby extended, the boom is luffed, whereupon the guy support slews synchronously.

To achieve favorable hoisting conditions, the guy support can be adjusted between upright position and operating position, and specifically when the boom is raised, whereupon the guy support assumes a larger angle in relation to the boom when in upright position than when in operating position. The size of this angle between guy support and boom can vary in both upright and operation positions, in order on the one hand to achieve optimum hoisting conditions with a variety of geometries and on the other hand to make the luffing area of the boom sufficiently large. According to an advantageous embodiment of the invention, in upright position the guy support can assume an angle of 90° or more in relation to the boom, and when in operating position can assume an angle of less than 90° in relation to the boom. According to a favorable embodiment of the invention, when upright the guy support can be made to assume an angle of, for example, 100° in relation to the boom.

BRIEF DESCRIPTION OF SEVERAL VIEWS OF THE DRAWINGS

The invention is explained in greater detail below by means of a preferred embodiment and pertinent drawings showing.

DESCRIPTION OF THE PREFERRED EMBODIMENTS

Figure 1:
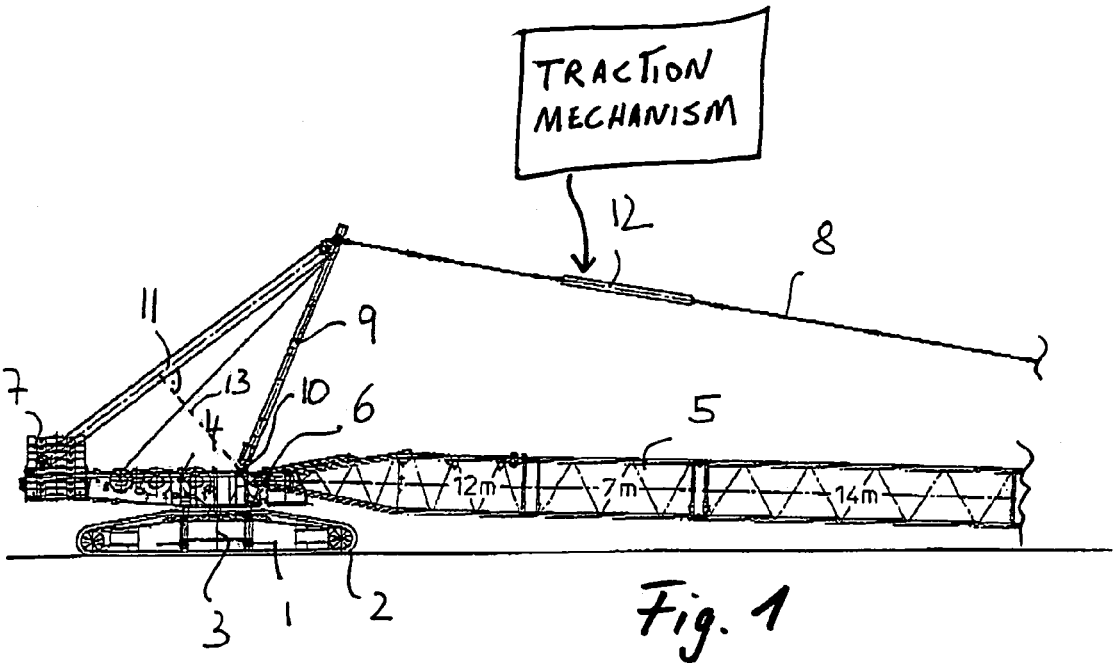
FIG. 1: A schematic side view of a crane with boom still lying on the ground, in which a guy support over which the boom guying is led is still in an initial position that corresponds to operating position.

The crane shown in the figures has a substructure 1 that includes a bogie assembly 2 in the form of a crawler bogie assembly with two parallel chains positioned to right and to left at a distance from each other. A superstructure or a rotating platform 4 is housed on substructure 1 to rotate on a vertical axle 3, which said superstructure or rotating platform 4 has at its front end a boom 5, over the tip of which said boom 5 a hoisting cable runs in known manner. The boom 5 is connected with rotating platform 4, and specifically at the front end thereof, so as to luff on an essentially horizontal luffing axle 6. At the back end of rotating platform 4, said back end facing boom 5, a ballast 7 is positioned on rotating platform 4, which said ballast 7 counters the moment induced by boom 5.

Guying 8 is fastened to boom 5 and is connected at the boom tip and/or between the boom tip and the boom 5 foot connected with rotating platform 4. Additionally, guying 8 is connected with the tip of a guy support 9, which is also connected near the boom 5 articulation point with rotating platform 4 in such manner that it can pivot, specifically on a pivoting axle 10 parallel to luffing axle 6. Additionally, adjustment cabling 11 is connected at the tip of guy support 9, which said adjustment cabling 11 has a multi-reeved adjustment cable and runs on a luffing winch positioned on rotating platform 4. Adjustment cabling 11 runs between the guy support tip and the back end of rotating platform 4 or a ballast connected with it, and serves for the luffing of boom 5. In addition to rotating platform ballast 7 a supplemental ballast can of course be connected with or hung on rotating platform 4. If necessary the adjustment cabling could also be connected with this supplemental ballast.

Length adjustment mechanism 12 in the form of a traction mechanism is installed in guying 8. In the illustrated embodiment, in which guying 8 is attached on the one hand to boom 5 and on the other hand to the tip of guy support 9, the length adjustment mechanism 12 is installed in guying 8 between the guy support tip and the boom. Length adjustment mechanism 12 can consist of an hydraulic cylinder and/or a regulating pulley. It forms an adjustment component whose effective length can be changed, whereby the length of guying 8 between guy tip and boom can in turn be changed.

Figure 2:
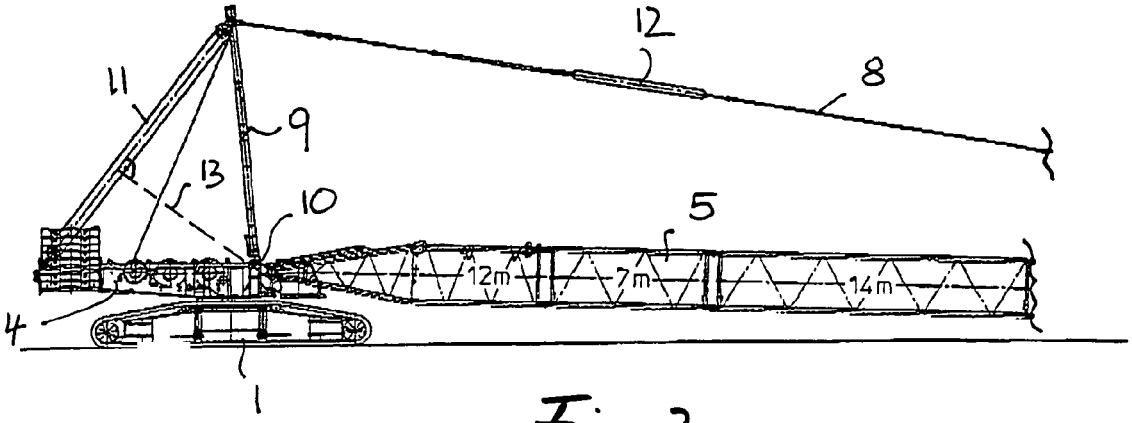
FIG. 2: A schematic side view of the crane of FIG. 1, in which the guy support is slewed backward into upright position in order to achieve favorable hoisting conditions for the raising of the boom.

To erect boom 5, the following procedure can be used, with the help of length adjustment mechanism 12:

With boom 5 still lying on the ground, guy support 9 can first be moved into its operating position, forward toward boom 5. Length adjustment mechanism 12 is then in its short position, so that guy support 9 assumes in relation to boom 5 an angle of less than 90° being between 70° and 80° in the illustrated embodiment. In this position, adjustment cabling 11 has a relatively unfavorable lever arm 13, as shown in FIG. 1. To improve lever arm 13 in relation to luffing axle 6 or pivot axle 10, length adjustment mechanism 12 is then moved into its long position, whereby guy support 9 is pivoted backward away from boom 5, as shown in FIG. 2. In this upright position, guy support 9 has a larger angle in relation to boom 5, being greater than 90°, in particular around 100°, in the illustrated embodiment. When guy support 9 is upright, adjustment cabling 11 has a better, i.e. longer, lever arm 13 in relation to the pivot axles of boom 5 or guy support 9, so that the forces introduced by adjustment cabling 11 exert greater torque on boom 5. Boom 5 can thereby be raised with less power in adjustment cabling 11.

Figure 4:
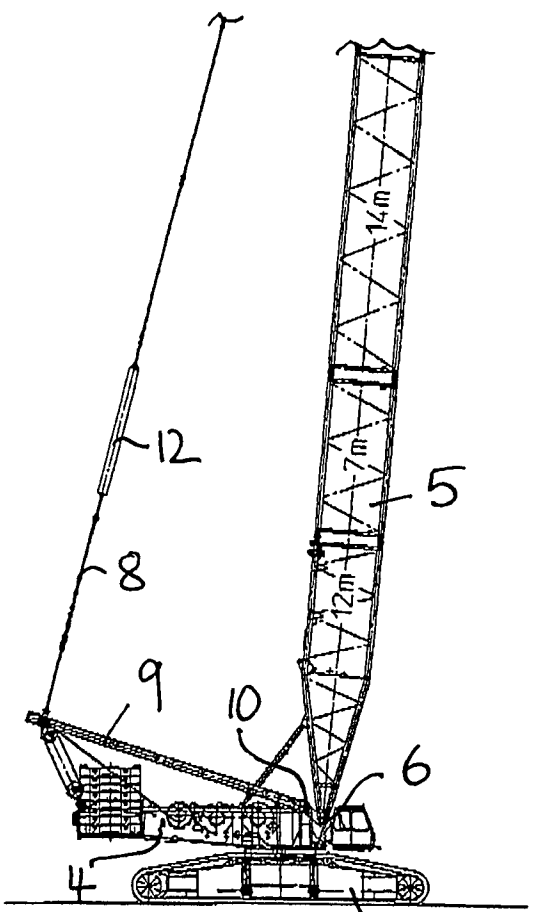
FIG. 4: a schematic side view of the crane of the preceding figures, in which the boom has been raised into completely vertical position and the guy support has been slewed toward the boom in its operating position.
Figure 3:
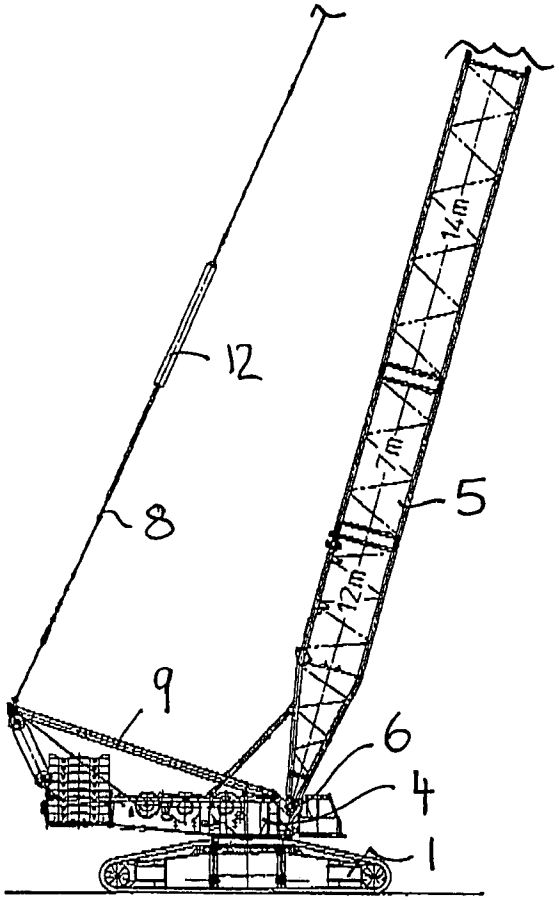
FIG. 3: A schematic side view of the crane of the preceding figures, in which the boom has already been raised slightly but the guy support has not yet been slewed into its operating position.

Boom 5 is first raised until guy support 9 is close to the top of rotating platform 4 or ballast 7, as shown in FIG. 3. To permit boom 5 to be luffed still further, length adjustment mechanism 12 is then moved into its short position. Guying 8 is thus shortened, whereby guy support 9 is pivoted toward boom 5. In this operating position, shown in FIG. 4, the angle between guy support 9 and boom 5 is accordingly smaller, preferably less than 90°. Boom 5 can thereby be luffed further, without guy support 9 being at the top of rotating platform or ballast 7.

The invention claimed is:

1. Crane comprising a rotating platform (4) structured and arranged to rotate on a vertical axle (3), a boom (5) connected with the rotating platform (4) and structured and arranged to luff on a luffing axle (6), a guy support (9) structured and arranged to pivot on an axle (10) parallel to the luffing axle (6) of the boom (5), guying (8) connected with an upper end of the boom (5) at one end thereof and an upper end or top of the guy support (9) opposite the pivoting axle (10) at an opposite end, adjustment cabling (11) structured and arranged for luffing the boom (5) and connected with the upper end of the guy support (9) and rotating platform (4), and an angle adjustment mechanism (12) installed along said guying (8) between ends of said guying (8) respectively connected to the upper end of the boom (5) and upper end or top of the guy support (9) and structured and arranged for adjusting, through adjusting length of said guying (8), an angle of the guy support (9) relative to the boom (5), such that when the boom (5) is positioned along the ground before raising, the guy support (9) is positioned to form an acute angle with the boom (5), said angle adjustment mechanism (12) then positions the guy support (9) to form an obtuse angle with the boom (5) positioned along the ground by slackening or increasing length of said guying (8), the boom (5) is raised to position the guy support (9) adjacent the rotating platform (4), and said angle adjustment mechanism (12) then shortens the length of said guying (8) to form an acute angle between the guy support (9) and boom (5), with said angle adjustment mechanism (12) positioned along said guying (8) constituting the primary mechanism for adjusting the angle of said guy support (9) relative to the boom (5).

2. Crane according to claim 1, in which the length adjustment mechanism (12) is composed of a traction mechanism installed in the guying (8) and operated by external energy.

3. Crane according to claim 2, in which the adjustment mechanism (11) has a multi-reeved adjustment cable connected with the rotating platform (4) and guy support (9).

4. Crane according to claim 3, in which the guy support (9) can be adjusted between an upright position and an operating position, in which the guy support (9) assumes a larger angle in relation to the boom (5) when in upright position than when in operating position.

5. Crane according to claim 2, in which the guy support (9) can be adjusted between an upright position and an operating position, in which the guy support (9) assumes a larger angle in relation to the boom (5) when in upright position than when in operating position.

6. Crane according to claim 2 wherein the traction mechanism is an hydraulic power lift and/or a regulating pulley.

7. Crane according to claim 1, in which the adjustment mechanism (11) has a multi-reeved adjustment cable connected with the rotating platform (4) and guy support (9).

8. Crane according to claim 7, in which the guy support (9) can be adjusted between an upright position and an operating position, in which the guy support (9) assumes a larger angle in relation to the boom (5) when in upright position than when in operating position.

9. Crane according to claim 1, in which the guy support (9) can be adjusted between an upright position and an operating position, in which the guy support (9) assumes a larger angle in relation to the boom (5) when in upright position than when in operating position.

10. Crane according to claim 9, in which the guy support (9) when in upright position assumes an angle of 90° or more in relation to the boom (5), and when in operating position assumes an angle of less than 90° in relation to the boom (5).

11. Process for raising a boom (5) of a crane comprising a rotating platform (4) structured and arranged to rotate on a vertical axle (3), with the boom (5) connected with the rotating platform (4) and structured and arranged to luff on a luffing axle (6), a guy support (9) structured and arranged to pivot on an axle (10) parallel to the luffing axle (6) of the boom (5), guying (8) connected with an upper end of the boom (5) at one end thereof and an upper end or top of the guy support (9) opposite the pivoting axle (10) at an opposite end, adjustment cabling (11) structured and arranged for luffing the boom (5) and connected with the upper end of the guy support (9) and rotating platform (4), and an angle adjustment mechanism (12) installed along said guying (8) between ends of said guying (8) respectively connected to the upper end of the boom (5) and upper end or top of the guy support (9) and structured and arranged for adjusting, through adjusting length of said guying (8) an angle of the guy support (9) relative to the boom (5), such that when the boom (5) is positioned along the ground before raising, the guy support (9) is positioned to form an acute angle with the boom (5), said angle adjustment mechanism (12) then positions the guy support (9) to form an obtuse angle with the boom (5) positioned along the ground by slackening or increasing length of said guying (8), the boom (5) is raised to position the guy support (9) adjacent the rotating platform (4), and said angle adjustment mechanism (12) then shortens the length of said guying (8) to form an acute angle between the guy support (9) and boom (5), with said angle adjustment mechanism (12) positioned along said guying (8) constituting the primary mechanism for adjusting the angle of said guy support (9) relative to the boom (5), said method comprising the steps of pivoting the guy support (9) away from the boom (5) when the boom (5) is lying on the ground and into an upright position with a larger angle between the boom (5) and guy support (9), then luffing the boom (5), and lastly pivoting the guy support (9) toward the boom (5) into operating position with a smaller angle between the boom (5) and guy support (9).

* * * * *